United States Patent [19]

Miyakawa et al.

[11] 4,401,741

[45] Aug. 30, 1983

[54] ONE-COMPONENT TYPE DEVELOPER

[75] Inventors: Nobuhiro Miyakawa, Suita; Kouzi Maekawa, Kyoto, both of Japan

[73] Assignee: Mita Industrial Co. Ltd., Osaka, Japan

[21] Appl. No.: 382,605

[22] Filed: May 27, 1982

[30] Foreign Application Priority Data

May 29, 1981 [JP] Japan ..... 56-80980

[51] Int. Cl.[3] ..... G03G 5/04

[52] U.S. Cl. ..... 430/110; 430/106.6; 430/903

[58] Field of Search ..... 430/106.6, 110, 903

[56] References Cited

U.S. PATENT DOCUMENTS 4,206,064 7/1980 Kiuchi et al. ..... 430/110
4,254,205 3/1981 Lu et al. ..... 430/110

FOREIGN PATENT DOCUMENTS 2902884 8/1979 Fed. Rep. of Germany ..... 430/903
54-34242 3/1979 Japan ..... 430/110
54-34243 3/1979 Japan ..... 430/110

*Primary Examiner*—John E. Kittle
*Assistant Examiner*—Merrell Chashion, Jr.
*Attorney, Agent, or Firm*—Sherman & Shalloway

[57] ABSTRACT

Disclosed is an electrically insulating, magnetic one-component type developer comprising an electrically insulating binder medium, and a magnetic material powder and a charge control agent dispersed in the binder medium, wherein the charge control agent comprises a negative or positive charge control agent and a charge control agent having a polarity opposite to that of said charge control agent at a weight ratio of from 1/0.05 to 1/1.5.

4 Claims, 2 Drawing Figures

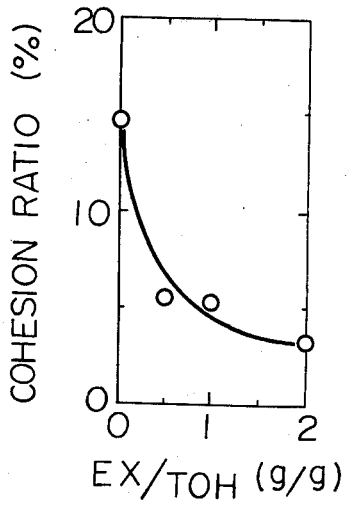
Fig. 1
Fig. 2
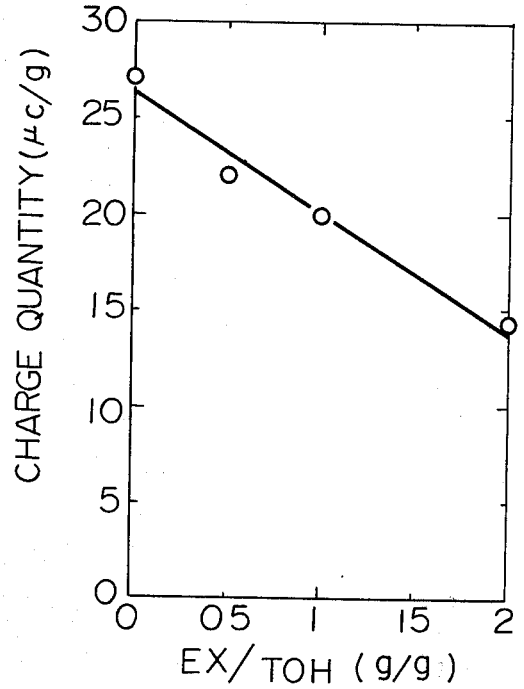

ONE-COMPONENT TYPE DEVELOPER

BACKGROUND OF THE INVENTION (1) Field of the Invention

The present invention relates to an electrically insulating, one-component type developer for electrophotography. More particularly, the present invention relates to an electrically insulating, magnetic one-component type developer, in which cohesion of developer particles is prevented and the flowability of developer particles is improved, and which can provide a developed image having an enhanced image density and a reduced fog density.

(2) Description of the Prior Art

As the developer capable of developing an electrostatic latent image without using a particular carrier, there is known a so-called one-component magnetic developer comprising a powder of a magnetic material contained in developer particles.

In this one-component type magnetic developer, there arise problems of cohesion of developer particles and reduction of the flowability of developer particles, which are not encountered in case of a two-component type developer. In the two-component type developer, toner particles having a relatively small particle size are electrostatically attracted to a magnetic carrier having a relatively large particle size and in this state, both the toner and carrier are supplied to a developing sleeve. In the developing sleeve, the stirring effect is given by revolution of the magnetic carrier. Therefore, cohesion of toner particles or reduction of the flowability of toner particles hardly become serious problems in the two-component type developer.

In the one-component type magnetic developer, however, since there is not contained a magnetic toner exerting the above function, there is a prominent tendency of developer particles to cohere to one another, and if this cohesion once takes place, the cohesion state is left without being broken, readily causing such troubles as reduction of the flowability of the developer and reduction of the image density. Especially in case of an electrically insulating one-component type magnetic developer comprising a magnetic material, optionally with a charge control agent, dispersed in an electrically insulating binder medium, since developer particles are readily charged by friction, electrostatic cohesion is readily caused to occur, and reduction of the flowability or image quality is a serious problem.

SUMMARY OF THE INVENTION

We found that in the above-mentioned electrically insulating one-component type magnetic developer, if a negative or positive charge control agent and a charge control agent having a polarity opposite to that of said charge control agent are used in combination at a certain ratio, the cohering tendency of developer particles is effectively eliminated, the flowability of the developer particles is prominently improved and at the developing step, the image density is prominently increased while prominently reducing the fog density.

It is therefore a primary object of the present invention to provide an electrically insulating or electroscopic one-component type magnetic developer in which the cohering tendency of the developer particles is drastically reduced and the flowability is highly improved.

Another object of the present invention is to provide an electroscopic one-component type magnetic developer which provides a high image density and a low fog density at the developing step.

Still another object of the present invention is to provide an electroscopic one-component type magnetic developer which can advantageously be used for high-speed reproduction and in which no substantial reduction of the image density or no substantial increase of the fog density is caused even if the developer is used for long-time continuous reproduction.

More specifically, in accordance with the fundamental aspect of the present invention, there is provided an electrically insulating, magnetic one-component type developer comprising an electrically insulating binder medium, and a magnetic material powder and a charge control agent dispersed in the binder medium, wherein the charge control agent comprises a negative or positive charge control agent and a charge control agent having a polarity opposite to that of said charge control agent at a weight ratio of from 1/0.05 to 1/1.5.

BRIEF DESCRIPTION OF THE DRAWINGS

FIG. 1 is a graph illustrating the relation between the mixing ratio of the positive charge control agent to the negative charge control agent (TOH) and the cohesion ratio.

FIG. 2 is a graph illustrating the relation between the above-mentioned mixing ratio and the charge quantity ($\mu C/g$).

DETAILED DESCRIPTION OF THE PREFERRED EMBODIMENTS

The most important feature of the present invention is that the present invention is based on the novel finding that in the case where in electroscopic one-component type magnetic developer particles is incorporated a charge control agent having a polarity opposite to the polarity of the charged electricity, the cohesion tendency of the developer particles is drastically reduced.

FIG. 1 of the accompanying drawings shows the relation between the mixing ratio of the positive charge control agent and the cohesion ratio in developer particles comprising Spilon Black TOH as the negative charge control agent and Nigrosine Base EX as the positive charge control agent. FIG. 2 shows the relation between the mixing ratio of the positive charge control agent and the charge quantity in the above-mentioned developer particles.

From FIGS. 1 and 2, it will readily be understood that with increase of the mixing ratio of the positive charge control agent to the negative charge control agent, the cohesion ratio of one-component type developer particles is drastically reduced while the frictional charge quantity of the developer particles is gradually decreased.

Therefore, according to the present invention, the cohering tendency of one-component type developer particles can be reduced and the flowability thereof can be improved, and the frictional charge quantity can be reduced to an appropriate level, with the result that the number of developer particles adhering to the unit charged image area is increased to increase the image density while the fog density in an obtained copy can be reduced. This functional effect attained according to the present invention will be apparent from Examples given hereinafter.

Known negative charge control agents can be used in the present invention. Among complex salt azo dyes containing chromium, iron or cobalt, those soluble in alcohols are preferably used. In the present invention, there are especially preferably used 2:1 type metal complex salt dyes represented by the following general formula:

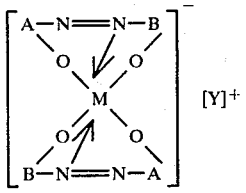

wherein A stands for a diazo component residue having a phenolic hydroxyl group at the ortho-position, B stands for a coupling component residue, M stands for chromium, iron or cobalt, and $[Y]^+$ stands for an inorganic or organic cation. Furthermore, sulfonylamine derivatives of copper phthalocyanine can be used for attaining the objects of the present invention.

Typical instances of these metal complex salt dyes are chromium-containing dyes of C.I. Acid Black 123, C.I. Solvent Black 22, C.I. Solvent Black 23, C.I. Solvent Black 28, C.I. Solvent Black 37, C.I. Solvent Black 42, C.I. Solvent Black 43, C.I. Solvent Red 8, C.I. Solvent Red 109, C.I. Solvent Yellow 80, C.I. Solvent Orange 37, C.I. Solvent Orange 45, C.I. Solvent Violet 21 and C.I. Solvent Blue 25.

Known positive charge control agents can optionally be used in the present invention, and oil-soluble dyes are especially preferably used. Suitable examples of the oil-soluble dyes that can be used in the present invention are Oleosol Blue G (C.I. Solvent Blue 11), Oriental Oil Blue K (C.I. Solvent Blue 12), Sudan Blue II (C.I. Solvent Blue 35), Sumiplast Blue OA (C.I. Solvent Blue 36), Zapon Fast Blue FLE (C.I. Solvent Blue 55), Aizen Spilon Blue (C.I. Solvent Blue 73), Sumiplast Green G (C.I. Solvent Green 3), Orient Oil Black HBB (C.I. Solvent Black 3), Nigrosine Base (C.I. Solvent Black 7), Victoria Blue (C.I. Solvent Blue 2), Orient Oil Yellow GG (C.I. Solvent Yellow 2), Zapon Fast Yellow CGG (C.I. Solvent Yellow 15), Aizen Spilon Yellow GRH (C.I. Solvent Yellow 61), Iketon Yellow GR Extra (C.I. Solvent Orange 1), Aizen Spilon Red BH (C.I. Solvent Red 81), Aizen Spilon Pink BH (C.I. Solvent Red 82), Aizen Spilon Red BEH (C.I. Solvent Red 83) and Orient Oil Violet #730 (C.I. Solvent Violet 13).

In the present invention, it is important that the negative charge control agent and positive charge control agent should be used at a weight ratio of from 1/0.05 to 1/1.5, especially from 1/0.1 to 1/1. If the mixing ratio of the positive control agent is below the above range, the effect of preventing cohesion of the developer particles is reduced, and if the mixing ratio of the positive control agent exceeds the above range, the charge quantity is drastically reduced, resulting in reduction of the image density.

The developer of the present invention comprising the above-mentioned charge control agents in combination is especially useful for developing positively charged latent images. If the developer of the present invention is used for developing negatively charged latent images, the above-mentioned mixing ratio may be reversed.

The one-component type magnetic developer of the present invention can be prepared according to customary procedures, except that the above-mentioned charge control agents are used in combination. For example, the one-component type magnetic developer of the present invention can be prepared by dispersing a powdery magnetic material and charge control agents in an electrically insulating binder medium and molding the dispersion into granules. Magnetite is preferably used as the powdery magnetic material, and it is especially preferred that magnetite having a particle size of 0.1 to 3 microns be used as the powdery magnetic material.

As the binder medium for dispersing the above-mentioned magnetite, there can be used resins, waxy materials or rubbers which show a fixing property under application of heat or pressure. These binder media may be used singly or in the form of a mixture of two or more of them. It is preferred that the volume resistivity of the binder medium be at least $1\times10^{15}$ Ω-cm as measured in the state where magnetite is not incorporated.

As the binder medium, there are used homopolymers and copolymers of mono- and di-ethylenically unsaturated monomers, especially (a) vinyl aromatic monomers and (b) acrylic monomers.

As the vinyl aromatic monomer, there can be mentioned monomers represented by the following formula:

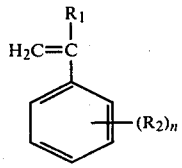

wherein $R_1$ stands for a hydrogen atom, a lower alkyl group (having up to 4 carbon atoms) or a halogen atom, $R_2$ stands for a substituent such as a lower alkyl group or a halogen atom, and n is an integer of up to 2 inclusive of zero, such as styrene, vinyl toluene, alpha-methylstyrene, alpha-chlorostyrene, vinyl xylene and vinyl naphthalene. Among these vinyl aromatic monomers, styrene and vinyl toluene are especially preferred.

As the acrylic monomer, there can be mentioned monomers represented by the following formula:

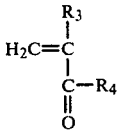

wherein $R_3$ stands for a hydrogen atom or a lower alkyl group, and $R_4$ stands for a hydroxyl group, an alkoxy group, a hydroxyalkoxy group, an amino group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide.

As another monomer to be used singly or in combination with the above-mentioned monomer (a) or (b), there can be mentioned, for example, conjugate diolefin monomers represented by the following formula:

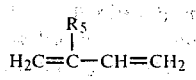

wherein $R_5$ stands for a hydrogen atom, a lower alkyl group or a chlorine atom, such as butadiene, isoprene and chloroprene.

As still another monomer, there can be mentioned ethylenically unsaturated carboxylic acids and esters thereof such as maleic anhydride, fumaric acid, crotonic acid and itaconic acid, vinyl esters such as vinyl acetate, and vinyl pyridine, vinyl pyrrolidone, vinyl ethers, acrylonitrile, vinyl chloride and vinylidene chloride.

It is preferred that the molecular weight of such vinyl type polymer be 3,000 to 300,000, especially 5,000 to 200,000.

In the present invention, it is preferred that the above-mentioned magnetite be used in an amount of 35 to 75% by weight, especially 40 to 70% by weight, based on the sum of the amounts of the binder medium and the powdery magnetic material. It also is preferred that the charge control agents be used in an amount of 0.5 to 10% by weight, especially 1 to 8% by weight, based on the binder. Magnetite and charge control agents are uniformly and homogeneously kneaded with the binder medium and the kneaded composition is granulated, whereby the intended one-component type magnetic developer is obtained.

Known auxiliary components for developers may be added according to known recipes prior to the above-mentioned kneading and granulating steps. For example, pigments such as carbon black and dyes such as Acid Violet may be added singly or in combination in amounts of 0.5 to 5% by weight based on the total composition so as to improve the hue of the developer. Furthermore, a filler such as calcium carbonate or powdery silica may be added in an amount of up to 20% by weight based on the total composition to obtain a bulking effect. In the case where fixing is effected by a heat roll, an offset-preventing agent such as a silicone oil, a low-molecular-weight olefin resin or a wax may be used in an amount of 2 to 15% by weight based on the total composition. In the case where fixing is effected by means of a pressure roll, a pressure fixability-improving agent such as paraffin wax, an animal or vegetable wax or a fatty acid amide may be used in an amount of 5 to 30% by weight based on the total composition.

Shaping of the developer can be accomplished by cooling the above-mentioned kneaded composition, pulverizing the composition and, if necessary, classifying the pulverization product. Mechanical high-speed stirring may be conducted so as to remove corners of indeterminate-shape particles.

It is ordinarily preferred that the average particle size of the developer particles be in the range of 5 to 35 microns, though the particle size of the developer particles is changed to some extent according to the intended resolving power.

In order to further improve the flowability of the one-component type magnetic developer of the present invention, a flowability improving agent such as gas phase method silica may be dry-blended or sprinkled according to known means.

The present invention will now be described in detail with reference to the following Examples that by no means limit the scope of the invention. Incidentally, in the Examples, all of "parts" and "%" are by weight unless otherwise indicated.

EXAMPLE 1

Charge control agents shown in Table 1 were sufficiently mixed with 55 parts of magnetite ($Fe_3O_4$) having a coercive force of 148 Oe, an apparent density of 0.635 g/ml and a number average particle size of 1μ, 37 parts of a vinyltoluene/2-ethylhexyl acrylate copolymer (having a weight average molecular weight of 83,000), 8 parts of low-molecular-weight polypropylene (having an average molecular weight of 4,000) and 0.5 part of zinc stearate, and the mixture was kneaded and molten by a two-roll mill, naturally cooled and roughly pulverized by a cutting mill to obtain particles having a size of 0.5 to 2 mm. Then, the particles were finely pulverized by a jet mill and classified by a zigzag classifying machine to obtain a magnetic toner having a particle size of 5 to 25μ (50% volume diameter=10.4μ). Then, the toner was mixed with hydrophobic silica (R-972 supplied by Nippon Aerosil) in an amount of 0.3% based on the toner to obtain a magnetic developer.

Incidentally, the coercive force was measured by a magnetic property-measuring device (Model VSMP-1 supplied by Toei Kogyo K. K.; magnetic field=5 KOe), the apparent density was measured according to the method of JIS K-5101, and the particle size was determined from an electron microscope photograph.

The following copying test was carried out by using the so-prepared five magnetic toners.

In a copying machine comprising a selenium drum (outer diameter=150 mm) as a photosensitive material, the intensity of a magnetic field on a developing sleeve (outer diameter=33 mm) having a magnet disposed therein through a non-magnetic member was adjusted to about 900 gauss, and the magnetic toner was applied to a developing roller of the so-called two-rotation system capable of rotating the magnet and the sleeve independently, while adjusting the distance between a spike-cutting plate and the sleeve to 0.3 mm. An arrangement was made so that the magnetic toner was supplied to the developing roller zone from a hopper. The distance between the surface of the photosensitive material and the developing roller was adjusted to 0.5 mm. The developing sleeve and photosensitive material were rotated in the same direction, and the magnet was rotated in the opposite direction. Under the foregoing conditions, charging (+6.7 KV), exposure, development, transfer (+6.3 KV), heater roller fixation and fur brush cleaning were performed. The copying speed was so that 30 copies of the A-4 size were obtained per minute. Slick paper having a thickness of 80 microns was used as a transfer sheet. The results of the copying test are shown in Table 1. The image density was measured on a solid black portion by using a commercially available reflective densitometer (supplied by Konishiroku Shashin Kogyo K. K.).

Separately, for evaluating the flowability of the toner, the cohesion degree was measured by using a commercially available powder tester (supplied by Hosokawa Tekkosho) to obtain results shown in Table 1. A smaller value of the cohesion degree indicates a higher flowability.

TABLE 1

| Toner No. | Charge Control Agents* (parts by weight) Negative | Positive | Image Density | Background Density | Cohesion Degree (%) |
|---|---|---|---|---|---|
| 1 | 0.64 | 0 | 1.11 | 0.11 | 12.5 |
| 2 | 0.64 | 0.13 | 1.31 | 0.10 | 8.8 |
| 3 | 0.64 | 0.32 | 1.38 | 0.09 | 5.5 |
| 4 | 0.64 | 0.64 | 1.34 | 0.08 | 4.9 |
| 5 | 0.64 | 1.28 | 1.00 | 0.08 | 3.3 |

Note
*Spilon Black TOH supplied by Hodogaya Kagaku was used as the negative charge control agent Nigrosine EX supplied by Orient Kagaku was used as the positive charge control agent From the results shown in Table 1, it is seen that by incorporation of the positive charge control agent, the image density was improved while fogging was reduced and also the flowability was improved.

EXAMPLE 2

A magnetic toner was prepared in the same manner as described in Example 1 by using 30 parts of magnetite having a coercive force of 74 Oe, an apparent density of 0.690 g/ml and a number average particle size of 2.7μ, 20 parts of magnetite having a coercive force of 60 Oe, an apparent density of 0.460 g/ml and a number average particle size of 0.52μ, 43 parts of a styrene/butyl methacrylate copolymer (having a weight average molecular weight of 71,000), 7 parts of low-molecular-weight polypropylene, 0.5 part of calcium stearate, 0.7 part of a negative charge control agent (Bontron S-31 supplied by Orient Kagaku) and 0.21 part of a positive charge control agent (Nigrosine EX). The toner was tested in the same manner as described in Example 1. It was found that the image density was 1.42, the background density was 0.09 and the cohesion degree was 6.0%.

When the positive charge control agent was not incorporated, the image density was 1.23, the background density was 0.11 and the cohesion degree was 11.

What we claim is:

1. An electrically insulating, magnetic one-component type developer comprising an electrically insulating binder medium, and a magnetic material powder and a charge control agent dispersed in the binder medium, wherein the charge control agent comprises a negative or positive charge control agent and a charge control agent having a polarity opposite to that of said charge control agent at a weight ratio of from 1/0.05 to 1/1.5.

2. A developer as set forth in claim 1, wherein the negative charge control agent and positive charge control agent are used in combination at a weight ratio of from 1/0.1 to 1/1.

3. A developer as set forth in claim 1 or 2, wherein the negative charge control agent is a complex salt azo dye containing chromium, iron or cobalt, and the positive charge control agent is an oil-soluble dye.

4. A developer as set forth in claim 1 or 2, wherein the total amount of the charge control agents is 0.5 to 10% by weight based on the amount of the binder medium.

* * * * *